United States Patent [19]

Kazeva

[11] 3,936,323

[45] Feb. 3, 1976

[54] METHOD FOR PRODUCING FERRITIC STAINLESS STEEL HAVING HIGH ANISOTROPY

[75] Inventor: Richard Kazeva, Lower Burrell, Pa.

[73] Assignee: Allegheny Ludlum Industries, Inc., Pittsburgh, Pa.

[22] Filed: Jan. 13, 1975

[21] Appl. No.: 540,366

[52] U.S. Cl. ..... 148/12 EA
[51] Int. Cl.[2] ..... C21D 9/48
[58] Field of Search ..... 148/12 EA

[56] References Cited

UNITED STATES PATENTS

| | | | |
|---|---|---|---|
| 2,772,992 | 12/1956 | Kiefer et al. | 148/12 EA |
| 2,808,353 | 10/1957 | Leffingwell et al. | 148/12 EA |
| 3,139,358 | 6/1964 | Graziano | 148/12 EA |
| 3,650,848 | 3/1972 | Schneider et al. | 148/12 EA |
| 3,684,589 | 8/1972 | Brickner et al. | 148/12 EA |

*Primary Examiner*—W. Stallard
*Attorney, Agent, or Firm*—Vincent G. Gioia; Robert F. Dropkin

[57] ABSTRACT

There is disclosed a method for preparing nominally 13% chromium-0.3% columbium ferritic stainless steel by producing the steel to have very low content of residuals, carbon and nitrogen, hot rolling the steel, annealing the hot rolled steel, and cold rolling the annealed material to reduce the thickness at least 65 percent.

2 Claims, No Drawings

METHOD FOR PRODUCING FERRITIC STAINLESS STEEL HAVING HIGH ANISOTROPY

BACKGROUND OF THE INVENTION

Ferritic stainless steels have good properties for many uses that are not too demanding. For example, kitchen sinks, hubcaps, wheel covers and similar articles can be made of ferritic stainless steels. Ferritic stainless steel is strong, tough, corrosion resistant to environments found in uses such as those mentioned above, and it takes a high polish. In addition, the ferritic stainless steels, which usually contain about 13% chromium and iron, are relatively inexpensive for stainless alloys.

For many such uses of ferritic stainless steel, it is necessary to subject the stainless steel to a deep drawing process. However, deep drawing processes produce a condition known as roping or ridging in steels that are not adapted to deep drawing. Roping and ridging is characterized by parallel marks in the direction in which the material was previously rolled which creates a poor appearance that cannot be removed by polishing but must be removed by grinding if indeed it can be removed at all.

Steels having high anisotropy have good deep drawing characteristics. A measure of anisotropy is a mathematical relationship among the plastic strain ratios in the direction of rolling, across the direction of rolling, and 45 percent to the direction of rolling. This relationship is indicated by the notation "$\bar{R}$" and it is expressed as a number. The higher the number, the greater the anisotropy; and accordingly, the better the steel is for deep drawing. As an example, aluminum killed low carbon steel is an excellent steel for deep drawing, and it has an anisotropy ($\bar{R}$) of about 1.6.

THE INVENTION

This invention is a method for producing ferritic stainless steel having high anisotropy and, accordingly, having ability to be deep drawn. The process involves constituting a steel to contain iron, from about 12%w to about 14%w chromium, from about 0.2%w to about 1.0%w columbium, and a very low content of nitrogen, carbon, and residuals. Specifically, the steel should not contain more then 0.75%w total of carbon, nitrogen, silicon, manganese, molybdenum, nickel, and copper.

The alloy is cast and hot rolled to an intermediate thickness, after which the hot rolled material is annealed between 1600°F and 1900°F for a period of from 50 to 150 minutes per inch of thickness. The annealed material is then cold rolled to reduce its thickness at least 65 percent followed by another anneal of between 1600°F/1900°F and from 50/150 MPI. Steels made in accordance with the foregoing process have high anisotropy, and in fact have R values substantially higher than those values for aluminum killed low carbon steel.

To demonstrate this invention, three alloys were prepared which were all nominally 13% chromium ferritic stainless steels. The compositions of these alloys are set forth in Table I.

TABLE I

| Alloy No. | Composition %w C | Mn | P | S | Si | Cr | Ni | Al | N | Cb |
|---|---|---|---|---|---|---|---|---|---|---|
| 1 | 0.022 | 0.19 | 0.023 | 0.012 | 0.055 | 13.55 | 0.18 | 0.05 | 0.029 | >0.05 |
| 2 | 0.021 | 0.20 | 0.023 | 0.011 | 0.14 | 13.44 | 0.17 | 0.25 | 0.034 | 0.32 |
| 3 | 0.018 | 0.18 | 0.026 | 0.012 | 0.06 | 13.51 | 0.25 | 0.12 | 0.030 | 0.34 |

All of the alloys were prepared by melting suitable materials to produce a melt of the proper composition, casting the melt as solid ingots, and then hot rolling to a thickness of 0.125 inches. Some specimens of Alloy 2 were then annealed after hot rolling while others were not. Annealing was conducted at 1750°F for 100 minutes per inch of thickness. The annealed hot rolled alloy was then air cooled and cold reduced different amounts followed by an anneal with results shown in Table II.

TABLE II

| | % Cr | $\bar{R}$ |
|---|---|---|
| No anneal | 40 | 0.99 |
| No anneal | 53 | 1.26 |
| No anneal | 67 | 1.54 |
| Anneal | 40 | 1.37 |
| Anneal | 53 | 1.78 |
| Anneal | 67 | 2.20 |

Alloy No. 3 was prepared in the same manner as Alloy No. 2 except that it was annealed at 1700°F for 100 minutes per inch of thickness and cold reduced 84 percent. With this treatment, Alloy No. 3 had an anisotropy of 1.90.

Alloy No. 1 which contains no columbium, when hot rolled, annealed and cold rolled to a thickness reduction of 67 percent, followed by an anneal, had an anisotropy of 0.87.

When the alloys prepared with the process of the present invention are deep drawn, the deep drawing process is effected successfully without roping or ridging being evident in the products.

The data presented above indicate that the presence of columbium in the alloy employed in the process of this invention is essential. The data also indicate that annealing and cold reduction of at least 65 percent are required to produce the qualities in the alloy that make it suitable for deep drawing.

I claim:

1. A method for preparing deep drawing, stainless steel comprising:

A. preparing an alloy to contain from 12–14%w chromium, from 0.2–1.0% columbium, and not more than 0.75%w total of carbon, nitrogen, silicon, manganese, molybdenum, nickel, and copper;

B. hot rolling said alloy;

C. annealing said hot rolled alloy at a temperature of from 1600°F–1900°F for a period of from 50–150 minutes per inch of thickness; and D. cold rolling the annealed steel to reduce the thickness at least 65 percent.

2. The method of claim 1 wherein said alloy contains from about 0.02–0.5%w columbium.

* * * * *